US012226009B2

(12) United States Patent
Schreiber et al.

(10) Patent No.: US 12,226,009 B2
(45) Date of Patent: Feb. 18, 2025

(54) COSMETIC APPLICATOR

(71) Applicant: L'Oreal, Paris (FR)

(72) Inventors: Camille Schreiber, Clichy (FR); Audrey Thenin, Clichy (FR)

(73) Assignee: L'Oreal, Paris (FR)

( * ) Notice: Subject to any disclaimer, the term of this patent is extended or adjusted under 35 U.S.C. 154(b) by 30 days.

(21) Appl. No.: 16/643,718

(22) PCT Filed: Sep. 12, 2018

(86) PCT No.: PCT/EP2018/074643

§ 371 (c)(1),
(2) Date: Mar. 2, 2020

(87) PCT Pub. No.: WO2019/053080

PCT Pub. Date: Mar. 21, 2019

(65) Prior Publication Data

US 2020/0214435 A1 Jul. 9, 2020

(30) Foreign Application Priority Data

Sep. 12, 2017 (FR) ..... 1758408

(51) Int. Cl.
*A46B 9/02* (2006.01)
*A45D 40/26* (2006.01)
(Continued)

(52) U.S. Cl.
CPC ..... *A46B 9/021* (2013.01); *A45D 40/265* (2013.01); *A46B 3/18* (2013.01); *A46B 2200/106* (2013.01); *A46D 1/0238* (2013.01); *A46D 1/0253* (2013.01)

(58) Field of Classification Search
CPC .. A45D 40/262; A45D 40/264; A45D 40/265; A46B 3/00; A46B 3/10;
(Continued)

(56) References Cited

U.S. PATENT DOCUMENTS 722,714 A 3/1903 Kahn
731,575 A 6/1903 Johnston
(Continued)

FOREIGN PATENT DOCUMENTS

CA 2300665 A1 * 9/2000 ..... A46D 1/0238
CN 1317946 A 10/2001
(Continued)

OTHER PUBLICATIONS

CA2300665A1 (Year: 2000).*
(Continued)

*Primary Examiner* — Cris L. Rodriguez
*Assistant Examiner* — Karim Asqiriba
(74) *Attorney, Agent, or Firm* — Shumaker, Loop & Kendrick, LLP

(57) ABSTRACT

An applicator for applying a cosmetic composition to the eyelashes or eyebrows, including a core, at least one element attached to the core, each element comprising a central part fitted onto the core and at least one application member carried by the central part, this application member having a proximal half attached to the central part and a distal half extending outward from the proximal half, a composition collection surface being formed by a relief on the distal half that defines a concavity that is open radially toward the outside.

17 Claims, 7 Drawing Sheets

(51) Int. Cl.
*A46B 3/18* (2006.01)
*A46D 1/00* (2006.01)

(58) Field of Classification Search
CPC ..... A46B 3/104; A46B 2200/1046; A46B 2200/1053; A46B 2200/106; A46B 9/00; A46B 9/02; A46B 9/021; A46B 9/025; A46B 9/028; A46D 1/00; A46D 1/02; A46D 1/0238; A46D 1/0246; A46D 1/0253; A46D 1/0276; A46D 1/0292
USPC ..... D4/133, 128, 136
See application file for complete search history.

(56) References Cited

U.S. PATENT DOCUMENTS 735,643 A 8/1903 Winn
739,898 A 9/1903 Montain
748,420 A 12/1903 Richardson et al.
864,124 A 8/1907 Dunbar
912,355 A 2/1909 Becken
1,094,013 A 4/1914 Peterson
2,196,815 A 4/1940 Sawyer
2,299,770 A 10/1942 Solomon
2,329,361 A 9/1943 Solomon
2,348,339 A 5/1944 Golden
2,372,080 A 3/1945 Hahn et al.
2,446,781 A 8/1948 Norin
2,450,448 A 10/1948 Sawyer
2,559,940 A 7/1949 Cartheuser
2,478,872 A 8/1949 Conrad
2,479,631 A 8/1949 Liebert
2,508,799 A 5/1950 Reis, Jr.
2,566,965 A 9/1951 Shaw
2,574,891 A 11/1951 Sawyer
2,577,098 A 12/1951 Wood
2,669,239 A 2/1954 Smith
D179,923 S 3/1957 Solomon
2,806,476 A 9/1957 Thompson
2,814,302 A 11/1957 Goodwin
2,844,154 A 7/1958 Solomon
2,915,071 A 12/1959 Watkins
3,120,852 A 2/1964 Sawyer
3,214,777 A 11/1965 Kutik
3,256,545 A 6/1966 Lewis, Jr. et al.
3,459,199 A 8/1969 Connell
3,575,183 A 4/1971 Tanner, Sr.
3,872,873 A 3/1975 Tupper
4,030,845 A 6/1977 Deckert
4,461,312 A * 7/1984 Gueret ..... A46B 9/021 15/207.2
4,493,126 A 1/1985 Uy
4,504,998 A 3/1985 Price et al.
4,522,215 A 6/1985 Verducci
4,561,456 A 12/1985 Gueret
4,616,374 A 10/1986 Novogrodsky
5,191,670 A 3/1993 Lake et al.
D341,718 S 11/1993 Briganti
D345,440 S 3/1994 Van Dyk
5,386,839 A 2/1995 Chen
5,694,953 A 12/1997 Stephan et al.
5,761,760 A 6/1998 Dumler et al.
5,881,426 A 3/1999 Tong
5,926,904 A 7/1999 Warner
6,016,815 A 1/2000 Christoforou et al.
6,045,911 A 4/2000 Legrand et al.
6,086,373 A * 7/2000 Schiff ..... A46D 1/00 15/167.1
6,141,818 A 11/2000 Weihrauch
D453,076 S 1/2002 Naghibi
6,343,607 B1 2/2002 Gueret
6,412,496 B1 7/2002 Gueret
6,450,177 B1 9/2002 Christoforu et al.
6,616,366 B1 * 9/2003 Weihrauch ..... A46B 7/023 132/218
RE38,397 E 1/2004 Gueret
6,866,046 B2 3/2005 Gueret
D591,955 S 5/2009 Kulik
7,654,270 B2 2/2010 Gueret
7,992,577 B2 8/2011 De Brouwer et al.
8,091,562 B2 * 1/2012 Manici ..... A46B 9/021 132/218
8,210,763 B2 7/2012 Gueret
8,336,560 B2 12/2012 Dumler et al.
D677,904 S * 3/2013 Hammer ..... D4/136
8,438,689 B2 5/2013 Noble
8,474,086 B1 7/2013 Smith
8,568,049 B2 10/2013 Kulik
8,794,247 B2 8/2014 Kulik
8,899,241 B2 12/2014 Vandromme
8,905,050 B2 12/2014 Gueret
8,919,351 B1 * 12/2014 Wang ..... A46B 9/021 132/218
9,254,028 B2 2/2016 Gueret
D757,445 S * 5/2016 Rutigliano ..... D4/128
9,370,234 B2 6/2016 Lhoyer
9,420,874 B2 * 8/2016 Castex ..... A45D 40/265
9,427,075 B2 8/2016 Gueret
9,591,916 B2 * 3/2017 Kim ..... A45D 40/262
10,973,312 B2 4/2021 Pires et al.
2001/0035191 A1 11/2001 Lee
2002/0020424 A1 2/2002 Gueret
2002/0138929 A1 10/2002 Mehta
2003/0150075 A1 8/2003 Montoli et al.
2003/0163884 A1 9/2003 Weihrauch
2003/0213949 A1 11/2003 Gueret
2003/0230317 A1 12/2003 Montoli et al.
2004/0244809 A1 12/2004 Gueret
2005/0160546 A1 7/2005 Weihrauch
2005/0285439 A1 12/2005 Kubaitis
2006/0054179 A1 3/2006 Kuzuu
2006/0236484 A1 10/2006 Lee
2007/0034223 A1 2/2007 Dumler et al.
2007/0062552 A1 3/2007 De Brouwer et al.
2008/0142034 A1 * 6/2008 Manici ..... A45D 40/262 132/218
2009/0133707 A1 5/2009 Gueret
2009/0193602 A1 8/2009 Dumler et al.
2009/0194128 A1 * 8/2009 Vandromme ..... A46B 9/021 132/218
2009/0211047 A1 8/2009 Chen
2010/0037911 A1 * 2/2010 Kim ..... A46B 7/04 132/218
2010/0071715 A1 3/2010 Bickford
2010/0310295 A1 12/2010 Gueret
2011/0041867 A1 2/2011 Hsu
2011/0229246 A1 * 9/2011 Kulik ..... A46B 9/021 132/218
2012/0090635 A1 4/2012 Hsu
2012/0167910 A1 7/2012 Weigel
2012/0192892 A1 8/2012 Kulik
2013/0000663 A1 1/2013 Jacob et al.
2013/0055518 A1 * 3/2013 Jacob ..... A46B 9/025 15/160
2013/0133692 A1 5/2013 Withers et al.
2014/0003857 A1 1/2014 Gueret
2014/0016985 A1 1/2014 Osvaldo
2014/0105667 A1 * 4/2014 Castex ..... A46B 9/021 401/129
2015/0024080 A1 * 1/2015 Jacob ..... B29C 45/2626 425/542
2015/0071695 A1 3/2015 Kamm
2015/0335133 A1 * 11/2015 Kim ..... A46B 9/021 401/118
2016/0022012 A1 1/2016 Jacob et al.
2016/0023388 A1 1/2016 Jacob
2016/0073767 A1 * 3/2016 Sanchez ..... A45D 40/265 401/129
2016/0143419 A1 * 5/2016 Sanchez ..... A45D 40/265 401/129
2016/0295996 A1 * 10/2016 Rutigliano ..... A45D 40/262
2016/0360859 A1 * 12/2016 Uresti ..... A46B 1/00
2017/0000242 A1 1/2017 Jacob et al.

(56) References Cited

U.S. PATENT DOCUMENTS

| | | | | |
|---|---|---|---|---|
| 2017/0238678 | A1 | 8/2017 | Manici et al. | |
| 2017/0290291 | A1 | 10/2017 | Moeller et al. | |
| 2017/0290412 | A1* | 10/2017 | Pires | A46B 9/028 |
| 2018/0008028 | A1* | 1/2018 | Kim | A46B 7/044 |
| 2018/0242714 | A1 | 8/2018 | De Bardonneche | |
| 2018/0295965 | A1 | 10/2018 | Buck, Jr. et al. | |
| 2021/0169210 | A1 | 6/2021 | Chu | |
| 2021/0186183 | A1 | 6/2021 | Crapet | |

FOREIGN PATENT DOCUMENTS

| | | | |
|---|---|---|---|
| CN | 1868369 | A | 11/2006 |
| CN | 101496673 | A | 8/2009 |
| CN | 102525090 | A | 7/2012 |
| DE | 202011050794 | U1 | 9/2011 |
| DE | 20201001472 | U1 | 1/2012 |
| DE | 202010017159 | U1 | 4/2012 |
| EP | 0038524 | A2 | 10/1981 |
| EP | 0103205 | A1 | 3/1984 |
| EP | 0250680 | A1 | 1/1988 |
| EP | 0717944 | A1 | 6/1996 |
| EP | 1034722 | A2 | 9/2000 |
| EP | 1767118 | A1 | 3/2007 |
| EP | 2005857 | A1 | 12/2008 |
| EP | 2196106 | A1 | 6/2010 |
| EP | 2281478 | A2 | 2/2011 |
| EP | 2389833 | A2 | 11/2011 |
| FR | 2900319 | A1 | 11/2007 |
| FR | 2906692 | A1 | 4/2008 |
| FR | 3011168 | A1 | 4/2015 |
| FR | 3032869 | A1 | 8/2016 |
| WO | 0158309 | A1 | 8/2001 |
| WO | 02056726 | A2 | 7/2002 |
| WO | 2010013213 | A2 | 2/2010 |
| WO | 2010067314 | A1 | 6/2010 |
| WO | 2011013098 | A1 | 2/2011 |
| WO | 2012123675 | A1 | 9/2012 |
| WO | 2012137134 | A1 | 10/2012 |
| WO | 2014195914 | A1 | 12/2014 |
| WO | 2015110853 | A1 | 7/2015 |
| WO | 2016055649 | A1 | 4/2016 |
| WO | 2017098134 | A1 | 6/2017 |
| WO | 2020127707 | A1 | 6/2020 |
| WO | 2020127756 | A1 | 6/2020 |

OTHER PUBLICATIONS

International Search Report (ISR) for PCT/EP2018/074643 mailed Oct. 4, 2018 (4 pages).
Written Opinion of the International Searching Authority for PCT/EP2018/074643 mailed Oct. 4, 2018 (5 pages).
International Search Report (ISR) for PCT/EP2018/074648 mailed Oct. 4, 2018 (4 pages).
Written Opinion of the International Searching Authority for PCT/EP2018/074648 mailed Oct. 4, 2018 (5 pages).
International Search Report (ISR) for PCT/EP2018/074652 mailed Oct. 4, 2018 (4 pages).
Written Opinion of the International Searching Authority for PCT/EP2018/074652 mailed Oct. 4, 2018 (5 pages).
International Search Report (ISR) for PCT/EP2018/074641 mailed Oct. 4, 2018 (4 pages).
Written Opinion of the International Searching Authority for PCT/EP208/074641 mailed Oct. 4, 2018 (5 pages).
International Search Report (ISR) for PCT/EP2018/074656 mailed Oct. 8, 2018 (4 pages).
Written Opinion of the International Searching Authority for PCT/EP2018/074656 mailed Oct. 8, 2018 (6 pages).
Non-Final Office Action for U.S. Appl. No. 16/644,080 mailed Oct. 12, 2021 (23 pages).
English Translation and Office Action for Chinese Pat. Application No. 201880059372.8, mailed Feb. 9, 2021 (13 pages).
Non-Final Office Action for U.S. Appl. No. 16/644,027 mailed Nov. 23, 2021 (28 pages).
Final Rejection for U.S. Appl. No. 16/644,016 mailed May 18, 2022 (21 pages).
Non-Final Office Action for U.S. Appl. No. 16/644,027 mailed Apr. 8, 2022 (26 pages).
Non-Final Office Action for U.S. Appl. No. 16/644,016 mailed Jan. 14, 2022 (23 pages).
Final Rejection for U.S. Appl. No. 16/644,080 mailed Feb. 8, 2022 (30 pages).
Non-Final Office Action for U.S. Appl. No. 16/644,069 mailed Mar. 7, 2022 (30 pages).
Final Rejection for U.S. Appl. No. 16/644,069 mailed Sep. 7, 2022 (29 pages).
Final Rejection for U.S. Appl. No. 16/644,027 mailed Sep. 2, 2022 (20 pages).
Non-Final Office Action (NFOA) for U.S. Appl. No. 16/644,016, mailed Oct. 25, 2022 (20 pages).
Non-Final Office Action for U.S. Appl. No. 16/644,080 mailed Jul. 7, 2022 (23 pages).
De Bardonneche "FR 3032869 A1_translated" (Year: 2016) (6 pages).
Final Rejection (FR) for U.S. Appl. No. 16/644,080, mailed Jan. 31, 2023 (34 pages).
Liaw et al., "Plastic Deformation", 2009, ScienceDirect (Year: 2009) (11 pages).
Non-Final Office Action (NFOA) for U.S. Appl. No. 16/644,027, mailed Dec. 28, 2022 (29 pages).
Misselhorn, "DE_202010017159_U1_I_translated" (Year: 2012).
Final Rejection issued for U.S. Appl. No. 16/644,016, mailed May 8, 2023 (30 pages).
Non-Final Office Action (NFOA) issued for U.S. Appl. No. 16/644,069 mailed Mar. 15, 2023 (40 pages).
Final Rejection for U.S. Appl. No. 16/644,069, mailed Sep. 29, 2023 (47 pages).
Botto Paolo "EP-2196106-A1-translated" (Year: 2010).
Marcia Sue taylor "Alaska Native Artificates; Eskimos and Aleuts of the Bering Sea Rhythm of the Sea Collection" (Year: 2017).
Non-Final Office Action for U.S. Appl. No. 16/644,016, mailed Oct. 3, 2023 (39 pages).
Dictonary.com, Cross Definition, 2002 (Year: 2002).
Final Rejection (FR) issued for U.S. Appl. No. 16/644,027 mailed Aug. 21, 2023 (28 pages).
Non-Final Office Action for U.S. Appl. No. 16/644,080 mailed Jul. 19, 2023 (42 pages).
Non-Final Office Action issued for U.S. Appl. No. 16/644,027, mailed Jan. 22, 2024 (30 pages).
Notice of Allowance (NOA) issued for U.S. Appl. No. 16/644,069, mailed May 1, 2024 (10 pages).
Final Rejection (FR) issued for U.S. Appl. No. 16/644,016, mailed Feb. 29, 2024 (37 pages).
Supplemental Notice of Allowability issued for U.S. Appl. No. 16/644,069, mailed May 20, 2024 (2 pages).
Notice of Allowability issued for U.S. Appl. No. 16/644,016, mailed Jul. 1, 2024 (12 pages).
Final Rejection (FR) issued for U.S. Appl. No. 16/644,027, mailed Aug. 6, 2024 (29 pages).

* cited by examiner

COSMETIC APPLICATOR

TECHNICAL FIELD

The present invention relates to applicators for applying a cosmetic composition to the eyelashes or eyebrows, having an applicator part made up of a core and a plurality of elements attached to the core, each element having a central part fitted onto the core and at least one application member carried by the central part.

BACKGROUND

The patent U.S.Pat. No. 8,899,241 B2 discloses a first applicator of this type. The core is constituted for example by a metal hairpin folded on itself and twisted, or by a shaft of non-circular cross section, the central part being passed through by one or more openings with corresponding shapes.

The U.S. Pat. No. 9,591,916 B2 discloses further examples of applicators of this type, the central parts being in the form of disks that can be produced with complementary reliefs which allow them to be positioned with a mutually predefined angular orientation. The application members are constituted of simple spikes or, in a variant, of spikes that have short offshoots about a third of the way along their length. In further variants, the application members are in the form of tabs, the thickness of which decreases in the direction of the radially outer edge of the element, these tabs being flattened in one and the same plane as the central part. The tabs may be provided with concentric striations about the axis of the core, of small depth, or bosses or indentations of small size, forming a surface roughness.

There is a need to further improve applicators of this type, notably in order to have a good capacity for loading the eyelashes or eyebrows with cosmetic composition, while having satisfactory properties of combing and separating the eyelashes.

SUMMARY OF THE INVENTION

Exemplary embodiments of the invention aim to satisfy this need and relate to an applicator for applying a cosmetic composition to the eyelashes or eyebrows, comprising:

a core, at least one element attached to the core, each element comprising a central part fitted onto the core and at least one application member carried by the central part, this application member having a proximal half attached to the central part and a distal half extending outward from the proximal half, a composition collection surface being formed by a relief on the distal half that defines a concavity that is open radially toward the outside.

The "distal half" should be understood as being the portion situated at a distance above h/2 From the central part along the elongation axis of the application member, where h is the total length of the application member measured along the elongation axis of the application member, this elongation axis being able to be oriented radially.

A concavity that is "open radially toward the outside" should be understood as meaning that the axis of the concavity is oriented substantially radially. The axis of the concavity corresponds to the direction in which the concavity is open. This axis can be a median axis of symmetry for the concavity. It may be coincident with a median axis oriented perpendicularly to the bottom of the concavity. It may be coincident with the elongation axis and/or a radius, or make a relatively small angle with a radius coincident with the elongation axis of the application member, less than or equal to 30°.

Advantageously, the cosmetic composition intended to be applied to the eyelashes and/or eyebrows is a mascara composition. A mascara composition conventionally has a viscosity greater than 5 Pa·s, notably between 5 Pa·s and 50 Pa·s, at 25° C., in particular measured with the aid of a Rheomat RM 100® machine.

Such a mascara composition conventionally comprises a solids content, generally in an amount greater than or equal to 35% by weight relative to the total weight of the composition, a pulverulent colorant, in particular one or more pigments, notably one or more metal oxides, for example one or more iron oxides, and advantageously a film-forming polymer. A mascara composition may also conventionally comprise one or more waxes, in a total amount of in particular between 5 and 40% by weight relative to the total weight of the composition.

In the scope of the present invention, the applicator is particularly suitable for applying a relatively thick or viscous mascara composition. This is because a mascara composition having a relatively high viscosity will be retained particularly well on the composition collection surface and will not run off this collection surface, or only run off a little, under its own weight.

The invention makes use of the fact that said elements can be produced separately so as to form reliefs thereon which would be difficult, if not impossible, to realize on conventional injection-molded brushes, in which the application members are molded in one piece of thermoplastic material with the core, on account of the problems associated with demolding.

In one particularly preferred embodiment, in accordance with the teaching of the document U.S. Pat. No. 8,899,241 B2 or its equivalent FR 2 900 319, the core has a longitudinal axis and each element is threaded onto the core along its longitudinal axis before the core is twisted, the core and the element, in particular the core and the central part of the element, being mechanically connected in order to substantially prevent the element from pivoting freely on the core.

Such a mechanical connection with no possibility of relative rotation of the core and the element(s) threaded onto the latter before twisting can be obtained by means of a core produced in the form of an elongate element that is made of plastically deformable material and has a non-circular (for example polygonal, such as square, rectangular, triangular, etc., oval, multilobed, etc.) cross section in the non-twisted state, said core being threaded through an orifice of complementary cross section provided in the central part of each of the elements.

In a variant, the core comprises two wires made of plastically deformable material, for example two metal wires, optionally joined together at one of their ends by being produced from a single wire folded into the form of a hairpin, and the mechanical connection with no possibility of relative rotation of the core and the element(s) threaded onto the latter before twisting is obtained by threading the wires of the core in the non-twisted state into two orifices, preferably with complementary shapes, provided in the central part of each of the elements.

The core carrying the element(s) is then twisted so as to obtain a helical spread of the application members along the longitudinal axis of the core. The expression "the core is twisted" means here that the core, carrying the element(s), is subjected to torsion, realized for example by imparting on one of its parts a rotational movement about the longitudinal axis of the core (for example in the clockwise direction), while the other parts of the core remain rotationally fixed, or are subjected to a movement in the opposite direction (for example in the counterclockwise direction). This torsional force is realized so as to impart a plastic deformation on the core, such that the latter takes on its twisted shape in a stable and definitive manner once this torsional force stops being exerted on it.

The present invention is not limited to just the above-described embodiments for ensuring the mechanical connection with no possibility of relative rotation between the core and the element, in particular between the core and the central part of the element, but rather extends to all technical equivalents known to a person skilled in the art for producing such a connection.

The invention makes it possible to collect composition at a certain radial distance from the central part, which is easily accessible for the eyelashes, and makes it possible to load them with composition without it being necessary to introduce them deeply into the applicator part.

The invention makes it possible as it were to "lift" the level of the composition on the applicator part, by affording surfaces suitable for the collection thereof at a certain radial distance from the central part.

The application member(s) may be hollow and may thus define an internal cavity. This internal cavity of the application member makes it possible to collect product by surface tension and thus to increase the autonomy of the applicator and/or to increase the loading capacity of the applicator, without otherwise losing any capacity for separating and combing the eyelashes. This internal cavity preferably has a greatest dimension of at least 0.2 mm, better still at least 0.5 mm.

The application members can be produced easily with a shape suitable for separation and combing and in sufficient numbers to obtain a satisfactory makeup effect.

The invention makes it possible, if desired, to produce wide and hollow application members that are capable of being loaded with a relatively large amount of composition while retaining a certain amount of flexibility, by producing them with the aid of a strand of material which surrounds the cavity, this strand preferably being contained in a plane.

The strand of material can be given any shape depending on the desired characteristics, and notably a constant or non-constant cross section around the perimeter of the internal cavity. The strand of material can be given a shape that is narrower in places, if need be, in order to confer greater flexibility thereon. The strand has a cross section of for example between 0.04 and 1 $mm^2$ around at least a quarter of the perimeter of the internal cavity that it delimits, better still at least half this perimeter, or even three quarters or all thereof. The presence of the internal cavity gives the hollow application members greater flexibility in order to pass the wiping member with which the container from which the composition is taken is equipped.

The strand of material can comprise at least a portion with a variable curvature.

The strand of material can comprise at least a slope discontinuity that forms an elbow.

The greatest width of the, notably hollow, application members, measured perpendicularly to their elongation axis, is for example greater than or equal to 0.5 mm, being preferably between 0.5 and 5 mm, better still between 1 and 2 mm.

Preferably, the central part and the application members of an element are produced in one piece by molding thermoplastic material, notably from the same material. Each element which is mounted on the core can have between 4 and 24 application members.

The element may have hollow application members, the internal cavity of which has a closed contour, thereby helping to improve the mechanical integrity of the application member, since the latter can then be produced without a free strand of material.

It is thus possible to obtain application members which are both highly loadable with product and have a good capacity for combing and separating the eyelashes on account of their mechanical strength.

The fact that the applicator is produced with separate elements makes it possible to easily give the cavity of the hollow application members various shapes, and/or to form almost closed cavities of various shapes therebetween, the element being for example demolded along the axis of the central part, which is the general direction in which the core passes through the latter, this axis being able to be parallel to the axis of the cavity, which is the direction in which the cavity passes through the application member. If need be, notably when the axis of the cavity is oriented perpendicularly to a radius, demolding can be carried out with elastic deformation of the application member.

The cavity formed by a hollow application member can also be almost closed, that is to say that the strand of material which defines the cavity is interrupted over a short distance instead of extending through a closed loop. This distance is less than or equal to 0.3 mm, better still less than or equal to 0.2 mm, even better still less than or equal to 0.1 mm.

It is also possible, and this can be combined with the presence of hollow application members, to produce almost closed cavities on the applicator part, where the composition can collect, by adjusting the shape of the application members and the closeness thereof. Here too, the invention makes use of the fact that the presence of elements initially separate from the core makes it possible to produce them with shapes that are otherwise difficult, if not impossible to mold on a conventional injection-molded brush. Almost closed cavities should be understood as meaning that the adjacent application members are close together, at a non-zero radial distance from the central part, by a distance less than or equal to 0.3 mm, better still less than or equal to 0.2 mm, even better still less than or equal to 0.1 mm. The spacing is for example measured at at least 0.5 mm from the central part. For example, the adjacent application members have a succession of pointed arches which proceed from the core and define teeth, two of which are sufficiently close together for an almost closed cavity to be formed between the two application members by the portion thereof which extends from the teeth closest to the central part.

In exemplary embodiments, the hollow application member has a strand of material extending through a complete loop. This strand of material has for example a substantially constant cross section around the majority of the perimeter of the loop, or even around the entire perimeter of the loop.

This loop can extend entirely at a distance from the central part, and this can have the advantage of forming a reserve of product at a location relatively far away radially from the core, for example more than 3 mm from the surface of the central part, this constituting a significant difference compared with brushes produced by injection-molding plastics material with simple spikes, the reserve of product then being formed at the base of the spikes in these known brushes and not at a significant radial distance from the core.

In variant embodiments, the hollow application member has a strand of material extending through an incomplete loop closed by the central part. This can make it possible to give the application member a wider base, and thus greater stability, and to extend the cavity as far as the central part.

When the cavity of the hollow application member extends over the majority of the radial dimension of the application member, notably over more or less all of its height, apart from the thickness of the strand of material forming the loop, this tends to increase the amount of product which becomes housed in the application member and makes it possible to benefit from a reserve of product over more or less the entire height of the application member.

The width of the cavity, measured in the circumferential direction, that is to say perpendicularly to a median radius, may be constant or variable. When it varies, its variation can be chosen so as to collect more or less product at the desired distance from the core, depending on the desired makeup effect.

In variant embodiments, the hollow application member is toothed at its periphery. The teeth are for example formed by a succession of pointed arches that are concave toward the outside. The application member is for example in the overall shape of a holly leaf. The teeth that are present at the periphery of the application member can promote the catching of the eyelashes and also form reliefs that are suitable for collecting product at a radial distance from the central part of the element.

In variant embodiments, the application member has two lateral arches linked by a top arch, the lateral arches and the top arch preferably forming teeth at their meeting point. These teeth can help to comb and separate the eyelashes. The top arch can be concave toward the outside, in which case the concavity formed by the top arch makes it possible to collect product at a radial distance from the central part. The lateral arches can be concave in the opposite direction to the cavity formed therebetween. The application member can have a shape which widens toward the outside, away from the central part.

An applicator according to the invention can thus have one or more of the following characteristics, considered in isolation or in combination:

- the application member has two diverging arms that define said concavity between one another;
- the arms are rectilinear, said concavity having the overall shape of a V;
- the element comprises a plurality of application members that each have an X-shaped head that is attached to the central part by a leg;
- the element comprises at least one application member having an enlarged base, notably widening toward the central part, preferably having sides situated in continuation of the arms;
- the element comprises at least one toothed application member, the teeth being formed by a succession of pointed arches that are concave toward the outside, said concavity being formed by one of the arches;
- the concavity is open in a direction that makes an angle of less than or equal to 30° with the elongation axis of the application member;
- the element comprises at least one application member having two lateral arms joined together at their end by an arch having a concave shape defining said concavity;
- each element has a plurality of identical application members that each have said concavity;
- the core is twisted;
- the elongation axes of the application members of an element are coplanar;
- at least one application member of an element is flattened in a plane, and notably each application member of one and the same element is flattened in a flattening plane common to all the application members of the element;
- the application members of an element have their flattening plane oriented in a plane containing the axis of the central part.

A further subject of the invention is a packaging and application device having:

- a container containing the composition to be applied,
- an applicator according to the invention.

A further subject of the invention is a method for the cosmetic treatment of the eyelashes and/or eyebrows, notably for making them up, comprising the step of applying a cosmetic composition to the eyelashes with the aid of an applicator according to the invention.

BRIEF DESCRIPTION OF THE DRAWINGS

The invention may be better understood from reading the following detailed description of non-limiting exemplary embodiments thereof and from examining the appended drawing, in which.

DETAILED DESCRIPTION

Figure 1:
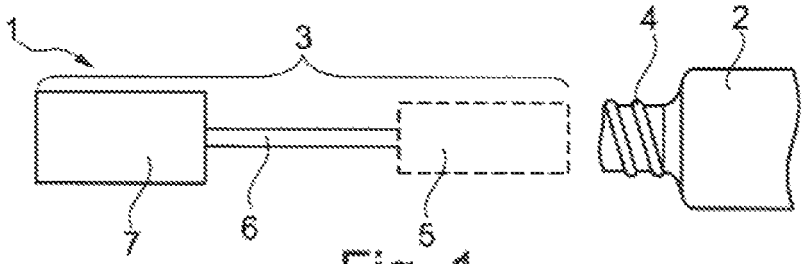
FIG. 1 shows a schematic and partial view of an example of a packaging and application device according to the invention.

The packaging and application device 1 displayed schematically and partially in FIG. 1 has a container 2 containing the composition to be applied and an applicator 3 for applying this composition.

The container 2 comprises a body which is provided for example, as illustrated, with a threaded neck 4 to which the applicator 3 can be fastened when the device 1 is not being used.

A wiping member (not visible in the figure) is secured in the neck of the container, in the usual manner. It may be a flexible lip with a conical, wavy or other shape.

The applicator 3 comprises an applicator part 5 which is used for applying the composition, this applicator part 5 being mounted at one end of a stem 6, the other end of which is carried by a gripping member 7 that also constitutes, in the example in question, a closure member for the container 2, being designed to be fastened to the neck 4.

The composition which is applied may be constituted by any cosmetic product intended for making up or for caring for the eyelashes and/or eyebrows. Preferably, it is mascara. The composition may notably include pigments, such as iron oxides, dispersed in an aqueous or anhydrous medium. The capacity of the container is preferably between 5 and 30 ml.

Figure 3:
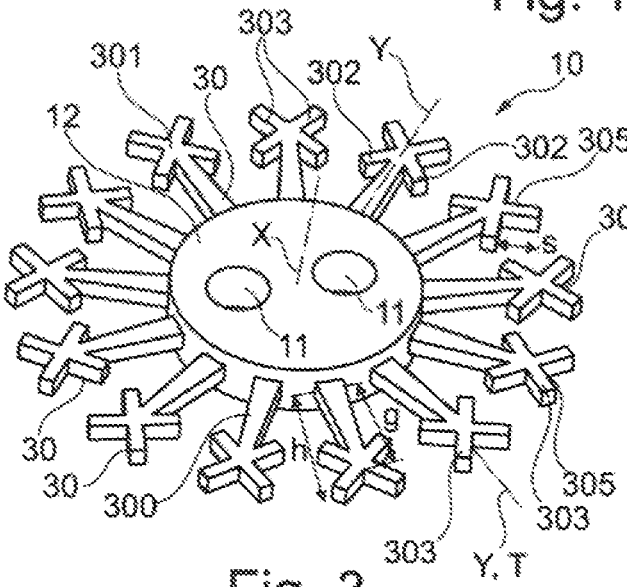
FIG. 3 shows an element used to produce the applicator part shown in FIG. 2, on its own.
Figure 2:
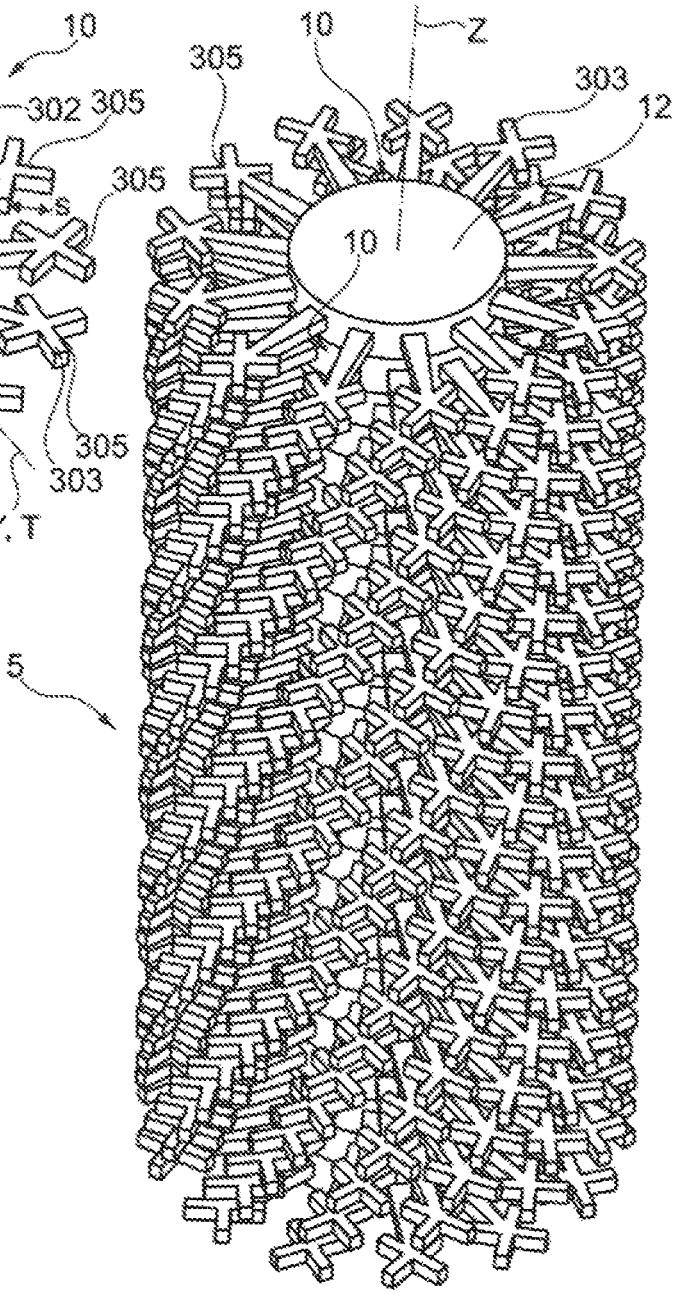
FIG. 2 shows the applicator part of an example of an applicator produced in accordance with the invention, on its own.

FIG. 2 illustrates an example of an applicator part 5 produced from individual elements 10, one of which has been shown on its own in FIG. 3.

The applicator part 5 is preferably produced in accordance with the teaching of the U.S. Pat. No. 8,899,241 B2. The elements 10 are thus mounted on a core 9 that holds them in a stacked manner and secures them relative to one another. This core 9 is for example a twisted core, produced from a metal wire folded into the form of a hairpin, as illustrated in FIG. 4.

Figure 4:
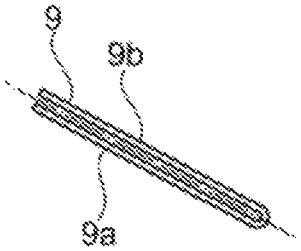
FIG. 4 shows an example of a core on which the elements can be mounted, the core being shown before the mounting of the elements and twisting.
Figure 25:
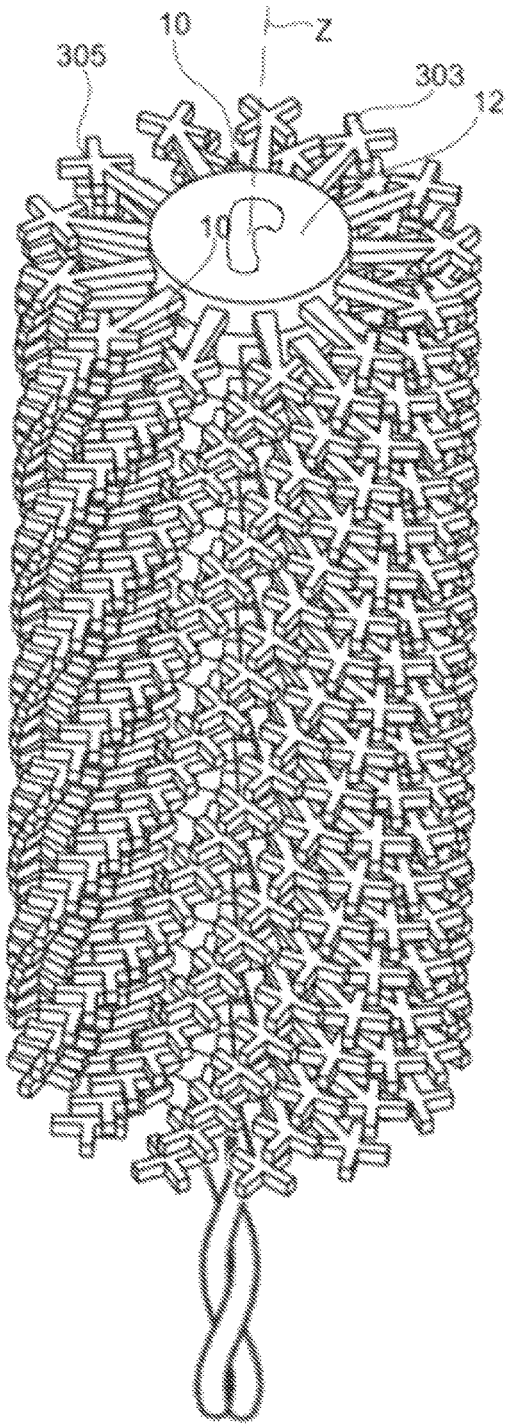
FIG. 25 illustrates an applicator part of an example of an application produced in accordance with the invention, with the twisted core.
Figure 26:
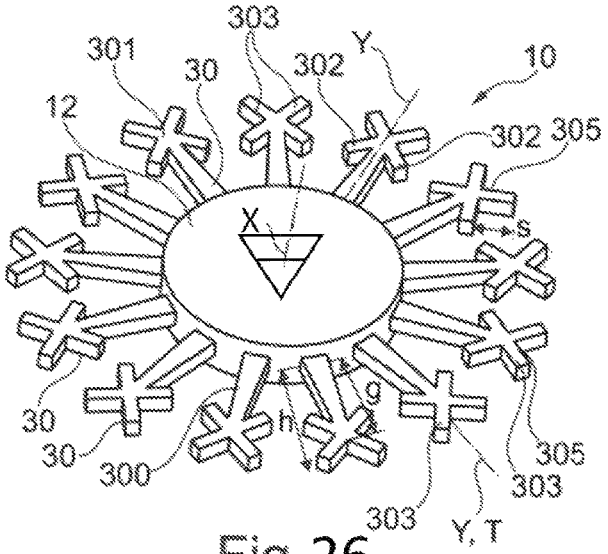
FIG. 26 shows a variant of an element used to produce the applicator part shown in FIG. 2, on its own.

In a variant, the core may be constituted by two separate metal wires that are positioned in a substantially parallel manner like the arms of the hairpin illustrated in FIG. 4. onto which the elements 10 are threaded and which are then twisted. An example of such a twisted core on which elements 10 are threaded is illustrated in FIG. 25.

The elements 10 have holes 11, which are shown schematically in FIG. 3, for the arms 9*a* and 9*b* of the core to pass through before the latter is twisted.

For the sake of clarity of the drawing, the core 9 has not been shown in FIG. 2, and the holes 11 passing through the central part 12 are only shown in FIG. 3.

In the example in question, the elements 10 are identical, but it would not constitute a departure from the scope of the present invention if elements 10 of different shapes were stacked on the core 9 within the applicator part 5.

As can be seen in FIG. 3, each element 10 has application members 30 which engage with the eyelashes or eyebrows while the applicator 3 is being used. The application elements 30 have, in this example, the same exterior shape, but it would not constitute a departure from the scope of the present invention if the exterior shapes were different.

The central part 12 is in the form of a flattened disk, the holes 11 for the arms 9*a*, 9*b* of the core 9 to pass through being disposed symmetrically relative to an axis X of the element 10, which may be an axis of symmetry for the central part 12.

The surface of the central part 12, to which the application members are joined, may be in the shape of a cylinder of revolution about the axis X, but further shapes are possible.

In the example illustrated, the application members 20 each have a flattened shape in a plane which is coincident with the flattening plane of the central part 12, this plane being perpendicular to the axis X and to the axis Z of the applicator part 5.

Each application member 30 comprises a radial arm 300 that is provided at its end with an X-shaped head 301 having two inner arms 302 oriented at 90° to one another toward the central part 12, and two outer arms 303 oriented at 90° to one another toward the outside.

The center of the X is situated on the elongation axis Y of the application member 30.

The length s of the arms 302 and 303 is for example between 0.1 and 3 mm, this length being able to be identical or different for the different arms of the head 301.

In the example in question, the arms 302 and 303 extend at an angle of about 45° to the elongation axis.

The inner arms 302 form hooks suitable for gripping the eyelashes introduced into the applicator part. Their reentrant orientation makes it possible to readily catch the eyelashes.

The outer arms 303 define between one another a cavity 305 of axis T coincident with the elongation axis Y, which is open radially toward the outside in the direction of the axis T and in which the composition may be accumulated by surface tension while remaining easily accessible for the eyelashes. The bottom of the cavity 305 is situated at a distance q from the central part 12 of for example between 0.5 and 7.5 mm, better still between 1 and 6 mm.

The ratio q/h, where h is the total height of the application member, is preferably greater than or equal to 25%, better still greater than or equal to 50%.

In order to produce the applicator part 2, the elements 10 are threaded onto the core 9 and then the latter is twisted, as per the teaching of the U.S. Pat. No. 8,899,241 B2. The number of elements 10 is for example between 2 and 100, better still between 5 and 15.

In order to manufacture the elements 10, they can be molded in a suitable mold such that demolding takes place along the axis X.

In general, any thermoplastic material can be used to mold the elements 10, regardless of the shape of the central part 12 and of the application members joined thereto. It is possible notably to use a polyolefin or a thermoplastic elastomer, for example of the SEBS type.

It is also possible to produce the element 10 from a non-thermoplastic material, for example a metal or ceramic material.

During the twisting of the core, the elements 10 can undergo rotation relative to one another, such that a progressive angular offset is created between the elements, along the core, as illustrated in FIG. 2, this being able, if appropriate, to create helical furrows in the applicator part 5.

In one variant, when the elements 10 are mounted on a non-twisted core, for example one that is constituted by a shaft of non-circular cross section, the central parts 12 having an opening with a corresponding shape so as to allow the central parts to be mounted on the shaft without rotation relative thereto, the elements 10 can be disposed on the core with their final orientation.

If appropriate, it is possible to produce the central parts 12 with complementary reliefs which cooperate so as to make it easier to position one element 10 in a predefined angular position about the longitudinal axis of the core relative to the adjacent elements 10.

Figure 5:
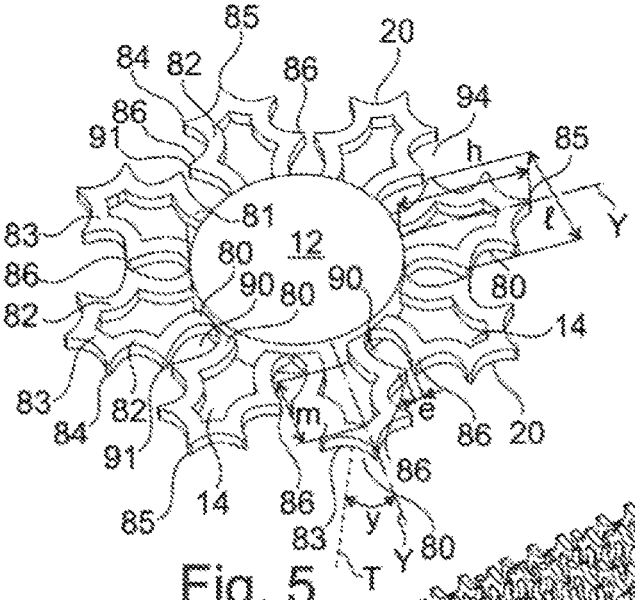
FIGS. 5, 7, 9, 11 and 13 are views similar to FIG. 3 of variant embodiments of the element.
Figure 6:
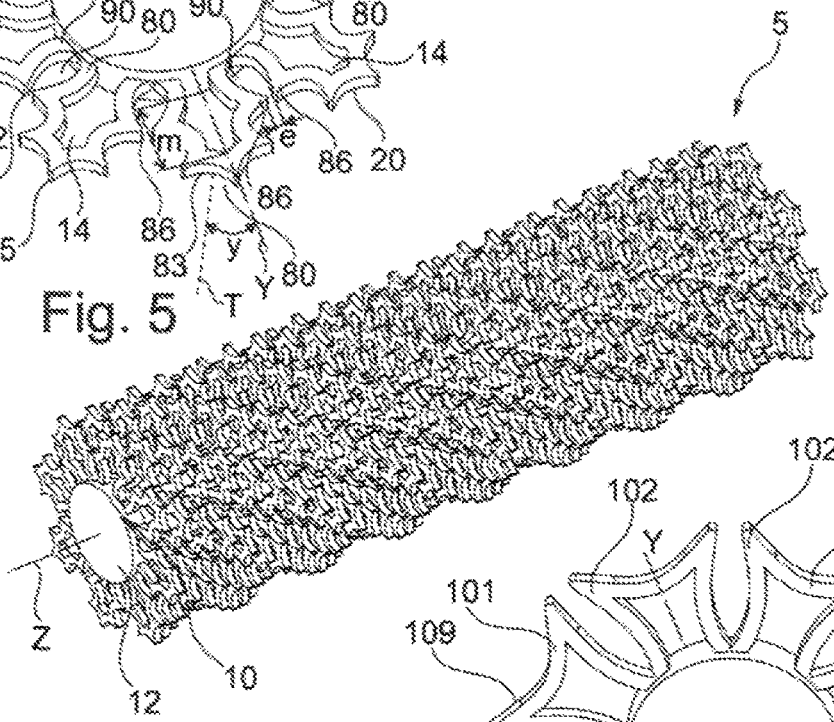
FIGs. 6, 8, 10, 12 and 14 show the applicator parts produced with the elements in FIGS. 5, 7, 9, 11 and 13, respectively.

The variant embodiment in FIGS. 5 and 6 has application members 20 which are hollow and each defines an internal cavity 14.

All of the application members 20 each have a toothed shape. The internal cavities 14 are each delimited by a strand of material 80 which describes a succession of pointed arches, which are concave toward the outside, teeth being formed at the meeting point between two arches. More particularly, in the example illustrated, the strand of material 80 describes, starting from the central part 12, a first pointed arch 81, which is joined to a second arch 82, forming a first tooth 86, this second arch 82 itself being joined to a third arch 83, forming a tooth 84.

Each application member 20 has a shape that is symmetric with respect to its elongation axis Y.

At their meeting point, the two arches 83 form a tooth 85, which defines the vertex of the hollow application member 20 and is situated on the elongation axis Y.

Each application member 20 thus has the overall shape of a holly leaf in this example, the internal cavity 14 extends over substantially the entire height of the application member 20, less the thickness taken up by the strand of material 80. The height m of the cavity 14, measured along the elongation axis Y, that is to say along a radius in the example in question, is thus greater than or equal to half the height h. There is for example the following relationship between l and h 0.5 h≤l≤2 h, wherein l denotes the greatest transverse dimension of the application member measured perpendicularly to the elongation axis Y.

FIG. 5 shows that the gap e which exists between two adjacent application members, at the teeth 86, is relatively small and for example less than or equal to 0.3 mm, and may notably be between 0.1 and 0.3 mm.

In the example illustrated, the application members 20 substantially meet at their base, where the strands of material 80 are joined to the central part 12. The fact that the teeth 86 of the adjacent application members are relatively close together makes it possible to form, between the first arches 81 of two adjacent application members, reserves of product in a relatively confined space 90 which only communicates with the outside through a relatively narrow opening 91, of width e. This width e may be less than or equal to 0.3 mm, better still less than or equal to 0.2 mm, even better still less than or equal to 0.1 mm.

The arches 82 which extend on either side of this narrow opening 91 define a space 94 in which the product may be accumulated, at a non-zero radial distance from the central part 12. The user thus has a reserve of product in this space 94, where the eyelashes can be introduced, while benefiting from teeth formed at the meeting point between the different arches in order to grip the eyelashes.

All of the concavities formed by the different arches form a corresponding number of indentations in which product can collect, thereby increasing the loading capacity of the applicator part 5.

The end arches 83 each define a cavity 89 that is open in a direction T that makes a relatively small angle y with the elongation axis Y, y being less than or equal to 30°, such that the cavity 89 is open substantially radially toward the outside. In the example illustrated, the direction T coincides with a median axis for the cavity 89, which is also the axis of symmetry for this cavity. The orientation of the cavity 89 makes it easier for the eyelashes to access the product that has collected inside. This access is even easier when the cavity 89 is present at the periphery of the applicator part 5, such that the eyelashes do not have to pass far into the applicator part in order to be loaded with product.

The relatively wide base of the application members 20 gives them good stability with respect to the forces which can be exerted while the applicator part 5 is being used, notably on passing through the wiping member or for applying the composition to the eyelashes and eyebrows. The cavity 14 helps to confer flexibility for passing through the wiping member on the application member.

On account of the twisting of the core, the elements 10 can be offset angularly around the longitudinal axis Z of the applicator part, as illustrated in FIG. 6.

A variant embodiment of the applicator part 5 will now be described with reference to FIGS. 7 and 8.

In this example, the element 10 only has hollow application members 20 that define a corresponding number of internal cavities 14.

Each application member 20 is formed by two lateral arches 100 that are joined at their distal end by a top arch 101, the lateral arches 100 and the top arch 101 being concave toward the outside. The arches 100 and 101 form teeth 102 at their meeting points.

The application member 20 is formed by a strand of material 105.

The top arch 101 defines a cavity 109 that is open in a direction T which coincides with the elongation axis Y of the application member 20 and is also a median axis of symmetry for the application member 20.

The product can collect in the cavity 109 defined by the top arch 101, the bottom of which is set back from the vertex of the teeth 102 along the elongation axis Y. Product can also collect in the internal cavity 14 formed by the strand of material 105. The facing lateral arches 100 of two adjacent application members 20 define a space 111 between one another, in which product can also collect. This space communicates with the outside through a narrow opening 112, this opening 112 leading out between the two teeth 102 of the two adjacent application members 20.

The fact that the opening 112 is narrow improves the retention of product between the application members 20.

The application members 20 of the example in FIG. 5 thus make it possible to collect product in the internal cavity 14, and also in the recess of the top arch 101.

The teeth 102 favor the catching of the eyelashes on account of their oblique orientation relative to the elongation axis Y. Finally, the relatively small spacing between the adjacent application members 20 also helps the eyelashes to catch, the latter being able to be introduced into the space 111.

In the example illustrated, the lateral arches 100 of two adjacent application members meet at their base. The number of application members 20 is equal to eight.

As illustrated in FIG. 6, the elements 10 can be angularly offset on account of the twisting of the core.

Figure 9:
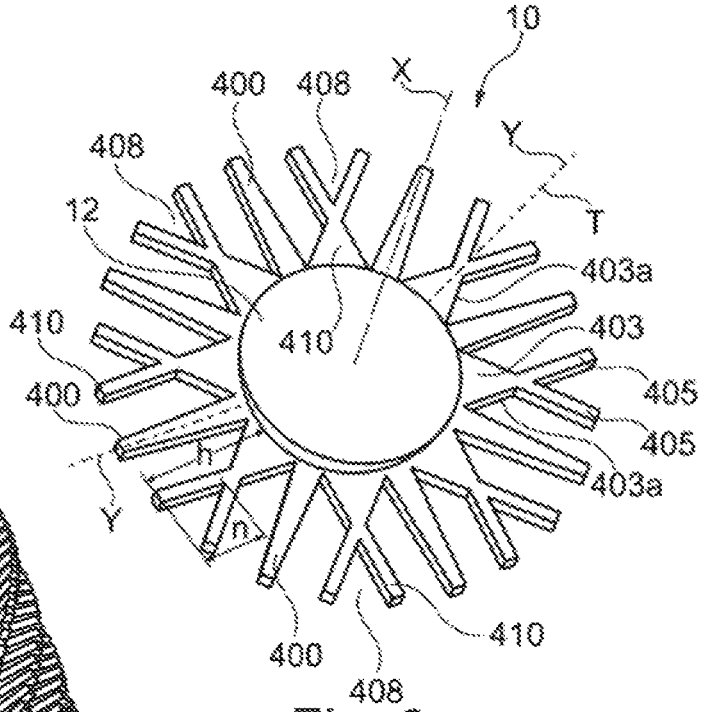

The element 10 shown in FIG. 9 has an alternation of application members 400 and 410 in the circumferential direction, around the central part 12.

The application members 400 are constituted of radial arms having a cross section that decreases toward their free end, the elongation axis Y of which is coincident with a radius.

The application members 410 have an enlarged base 403 with a triangular shape when viewed along the axis X of the central part 12, said enlarged base 403 meeting the base of the adjacent radial arms 400 at the central part 12.

Two V-shaped arms 405 are attached to the vertex of the base 403, these arms 405 extending in continuation of the sides 403*a* of the base 403 and forming between one another a cavity 408 that is radially open toward the outside in a radial direction T which coincides with the elongation axis Y. The arms 405 extend symmetrically to one another with respect to the elongation axis Y, which is an axis of symmetry for the application member.

The depth n of this cavity 408, measured along the elongation axis Y, is for example greater than or equal to 0.1 mm, better still greater than or equal to 0.5 mm.

The ratio n/h, where h denotes the total height of the application member, is for example between 25% and 50%.

The distance h-n from the bottom of the cavity 408 to the surface of the central part 12 is for example between 1.9 mm and 7.9 mm, better still between 1.5 mm and 4 mm.

The composition can collect in the cavity 408 at a non-zero radial distance from the surface of the central part 12.

Figure 10:
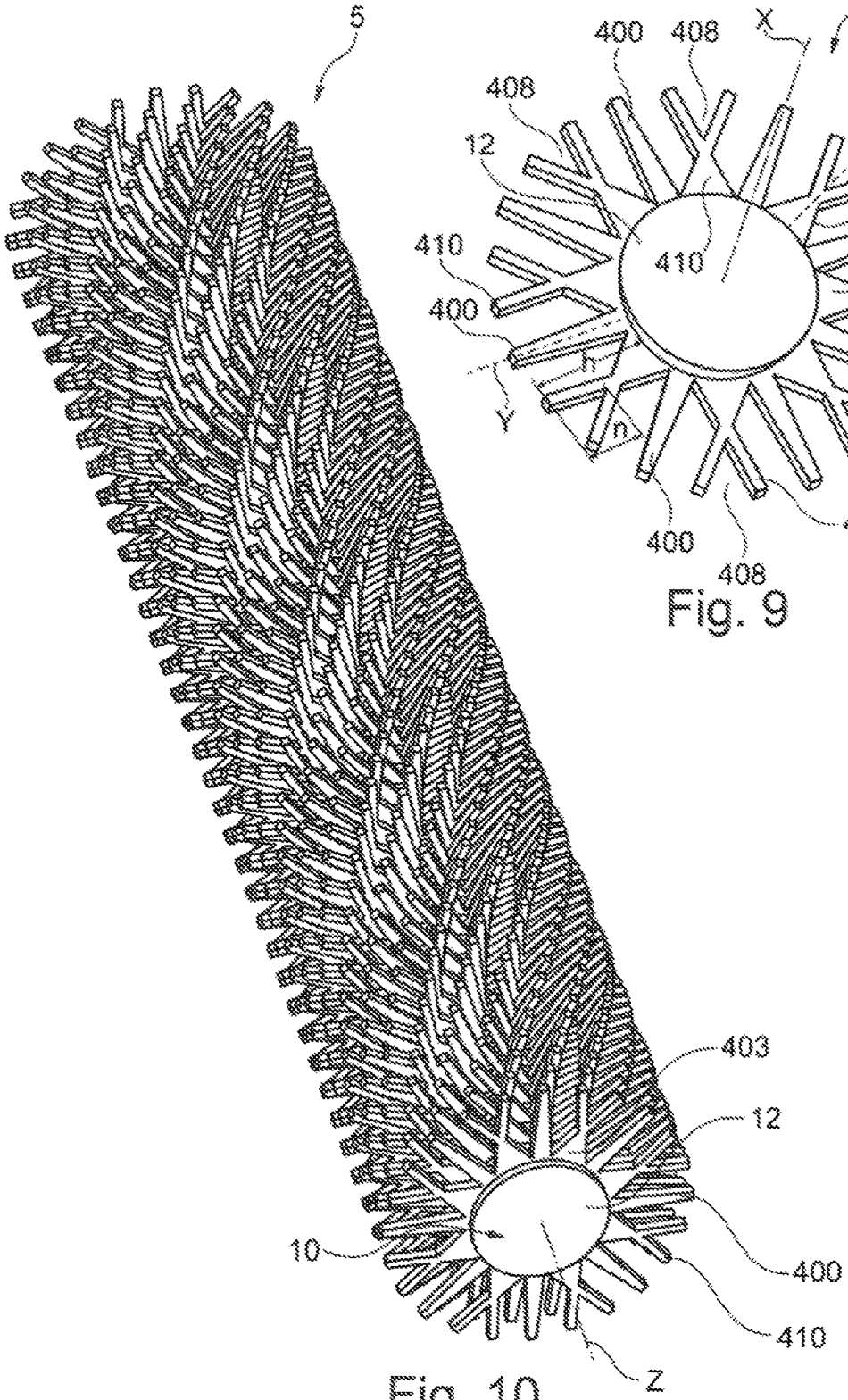

The elements 10 can be angularly offset on account of the twisting of the core, as illustrated in FIG. 10.

In the examples which have just been described with reference to FIGS. 2 to 10, the application members each have a flattened shape in the flattening plane of the central part 12, and have a thickness, measured along the axis X of the central part 12, which is less than or equal to the thickness of the latter. The application members can be given a different orientation without departing from the scope of the present invention, as will now be described with reference to FIGS. 11 to 14.

In the examples in these figures, each element 10 has a central part 12 that is thicker than in the above-described examples, and the application members each have a flattened shape in a plane which contains a radius and the axis X of the central part 12.

Figure 11:
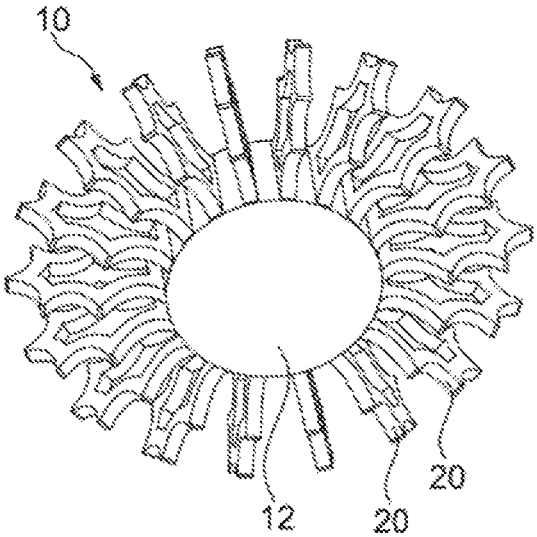
Figure 12:
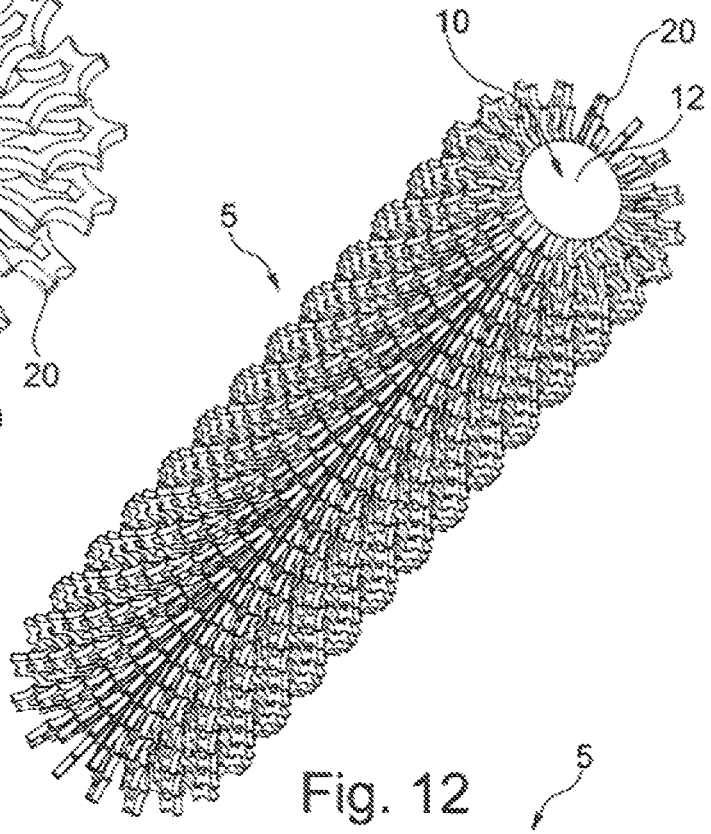

In the example in FIGS. 11 and 12, the elements 10 each have hollow application members 20 with the same shape as those in the example in FIGS. 5 and 6.

However, in this example, the application members are more numerous. The spacing between two consecutive application members in the circumferential direction is for example greater than the thickness of one application member.

The element 10 has for example 18 application members.

Figure 7:
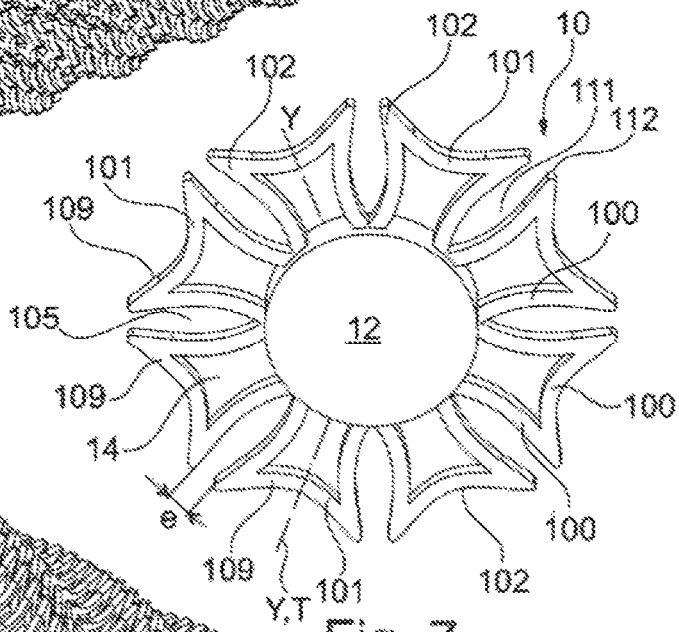
Figure 8:
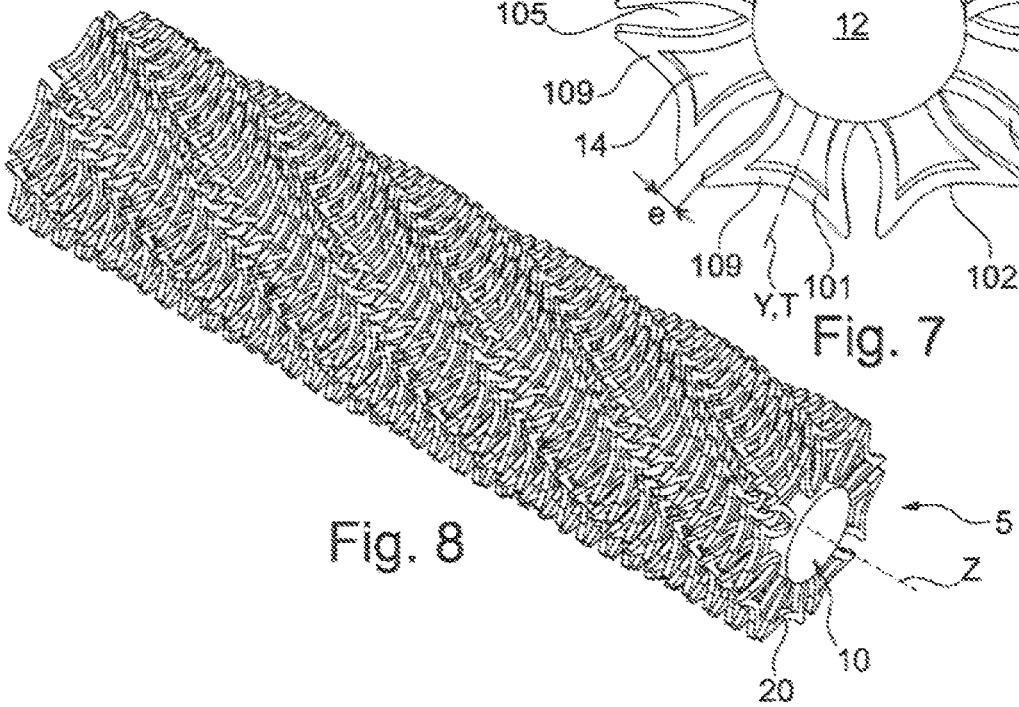
Figure 13:
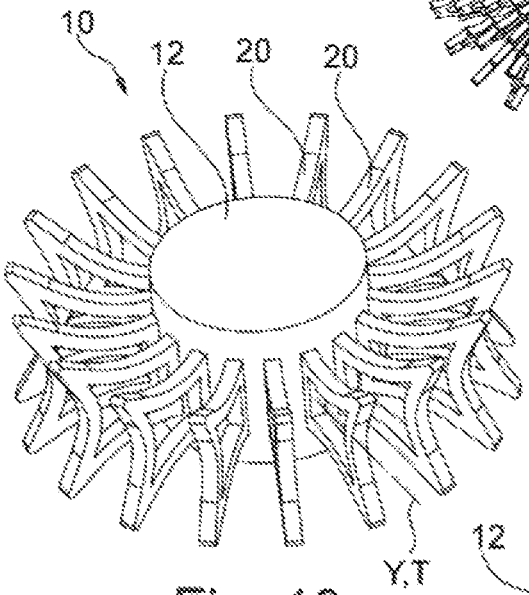
Figure 14:
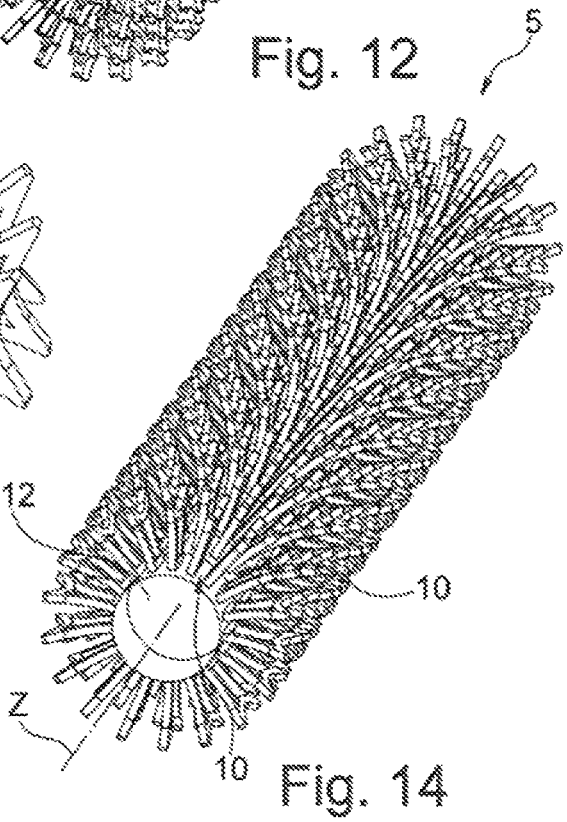

In the example in FIGS. 13 and 14, the application members 20 are identical to those in the example in FIGS. 7 and 8. The disposition thereof on the central part 12 is identical to that in the example in FIG. 11.

Figure 15:
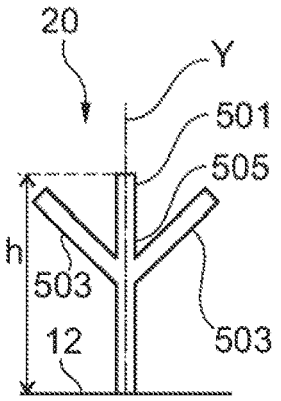
FIGS. 15 to 24 show variants of an application member of the applicator according to the invention.

In the variant embodiment shown in FIG. 15, the application member 20 comprises a central arm 501 and two lateral arms 503 that are disposed on each side of the distal half of the central arm 501 and diverge toward the outside. The lateral arms 503 may be formed by mere spikes.

Between the central arm 501 and each lateral arm 503, a V-shaped groove 505 opening toward the outside is present. Composition may accumulate in the V-shaped groove at a non-zero radial distance from the surface of the central part 12.

An eyelash can be introduced into this V-shaped groove 505, which can help to take hold of the eyelash in order to spread the composition on its surface.

Figure 16:
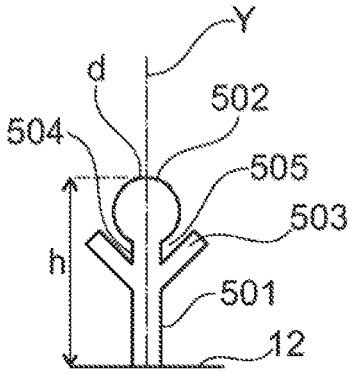

The central arm 501 can be provided at its end with an enlarged head 502, as illustrated in FIG. 16. The presence of the head 502 creates a discontinuity 504 at its base, which is able to improve the catching of the eyelashes by the applicator part.

The enlarged head 502 may be flattened along a flattening plane.

Furthermore, the enlarged head 502 may be hollow.

The enlarged head may have a rounded shape, for example the enlarged head is disc-shaped.

In a variant, the enlarged head has at least a chamfered side.

The depth d of this head 502, measured along the elongation axis Y, is for example greater than or equal to 0.1 mm, better still greater than or equal to 0.5 mm.

The ratio d/h is for example between 25% and 50%.

The distance h−d from the bottom of the head 502 to the surface of the central part 12 is for example between 1.9 mm and 7.9 mm, better still between 1.5 mm and 4 mm.

The lateral arms 503 may be disposed at different distance from the central part. The axes may have different angle of divergence.

Figure 17:
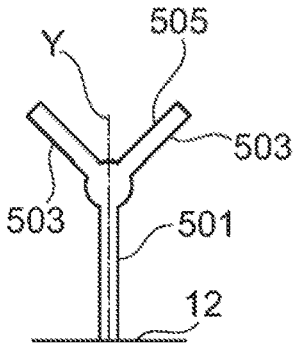

FIG. 17 discloses a further example in which the laterals arms 503 extend from the enlarged head 502.

The lateral arms 503 may extend toward the outside of the application member 20 as illustrated in FIGS. 15 to 17. In a non-illustrated variant, the lateral arms extend perpendicularly to the longitudinal axis of the application member 20 or toward the central part 12 of the application member. Two lateral arms 503 in a same longitudinal plane relative to the elongation axis Y of the application member 20 are represented in FIGS. 15 to 17. However, the application member 20 could comprise one or more than two lateral arms and the lateral arms could extend in different longitudinal plane relative to the elongation axis Y of the application member 20. The lateral arms 503 could have a different form than the one illustrated in FIGS. 15 to 17. For example, they could be shorter, curved or comprise an enlarged end.

Figure 18:
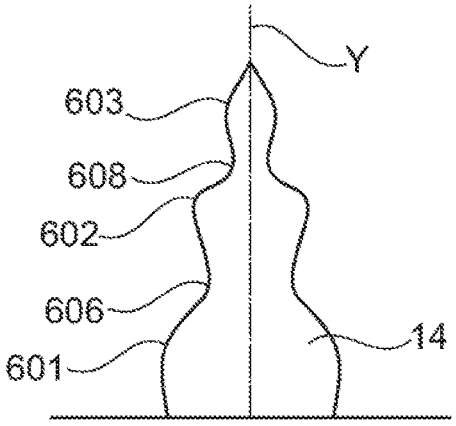

In the example of FIG. 18, the application members 20 are formed with a strand of material 620 comporting a succession of pointed arches that are convex toward the outside.

The application member 20 has a shape that is symmetric with respect to its elongation axis Y. The strand of material 620 successively describes, starting from the central part 12, a first arch 601, a second arch 602 and a third arch 603. The two arches 603 meet and form a tooth at the vertex of the application member 20. This tooth is situated on the elongation axis Y.

The arches 602 and 603 form, at their meeting point away from the cavity 14, a recess 608 which can accommodate composition. The same goes for the arches 601 and 602, which define a recess 609 at their meeting point.

In a variant, the application member 20 is not hollow and exhibits an external surface with a shape identical to the one shown in FIG. 18.

Figure 19:
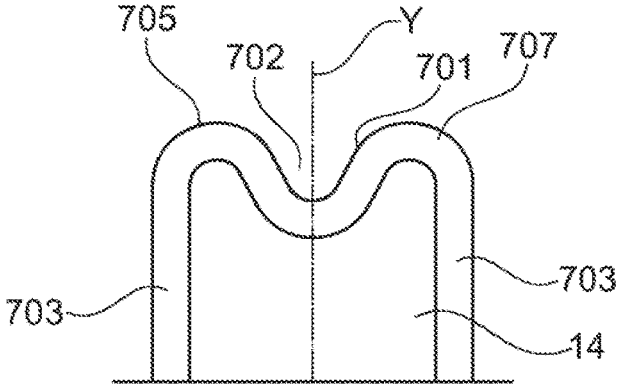

FIG. 19 displays a further embodiment in which the application member 20 is formed by two lateral legs 703 that are joined at their distal end by a top arm 701.

The top arm 701 presents an undulated form. This undulating form consists on a succession of arches, three in this example. Two arches 705 and 707 which are convex toward the outside and a central arch 702 that is concave toward the outside. Each of the two legs 703 and 709 has a rounded edge where it connects with the arches 705 and 707 respectively.

The central arch 701 defines a cavity 702 that is open toward the outside in a direction T which coincides with the elongation axis Y of the application member 20 and is also a median axis of symmetry for the application member 20.

The product can collect in the cavity 702 defined by the central arch 701. Product can also collect in the internal cavity 14 formed by the strand of material 105.

Hence, the application member 20 of the example illustrated in FIG. 19 makes it possible to collect product in the internal cavity 14, and also in the recess of the central arch 701.

Figure 20:
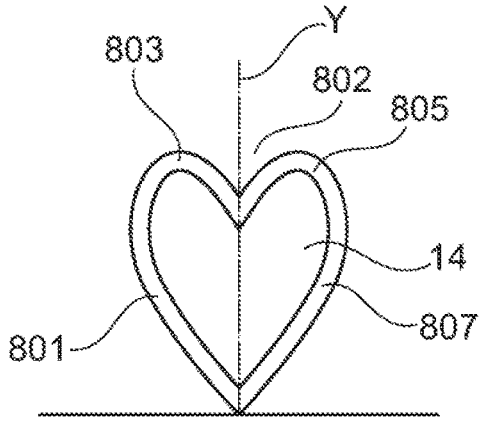

FIG. 20 displays a further example of application member according to the invention. This member is formed by a strand of material having a substantially heart-shape. This strand of material describes, starting from the central part 12, a first arm 801 extending from the central part 12 and angling upward from this central part 12, an upper V-shaped portion comprising a second arm 803 which is connected to the upper end of the first arm 801 and which has an upper rounded edge where it connects with the upper end of the first arm 801 and a third arm 805 which angles upward in the opposite direction than the first and second arms, starting from the free end of the second arm 803 and a fourth arm 807 extending at a downward angle to meet the first arm 801 and the central part 12.

The two arms 803 and 805 define a cavity 802 that is open in a direction which coincides with the elongation axis Y of the application member 20 and is also a median axis of symmetry for the application member 20.

The product can collect in the cavity 802 at a non-zero distance from the central part 12.

Product can also collect in the internal cavity 14 formed by the strand of material.

The application member 20 of the example of FIG. 20 thus makes it possible to collect product in the internal cavity 14, and also in the recess of the cavity 802.

In a variant, the application element 20 is not hollow and exhibits an external surface with a shape identical to the one shown in FIG. 20.

Figure 21:
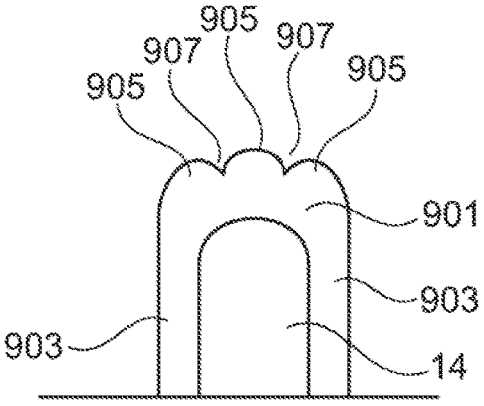

FIG. 21 displays a further embodiment in which the application member 20 is formed by two lateral legs 903 that are joined at their distal end by a top arm 901.

The top arm 901 presents on its side toward the outside of the application member 20 some reliefs 905 that form between them concavity 907 to accumulate products. The reliefs 905 illustrated in FIG. 21 are convex relief toward the outside but they could be any reliefs, as illustrated for example in FIGS. 23 and 24.

Figure 22:
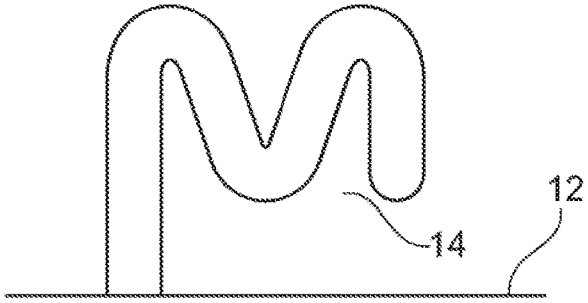
Figure 23:
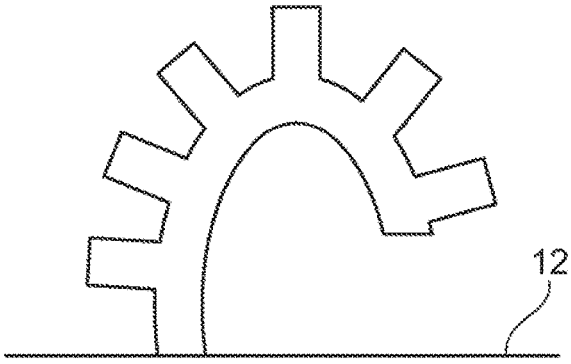
Figure 24:
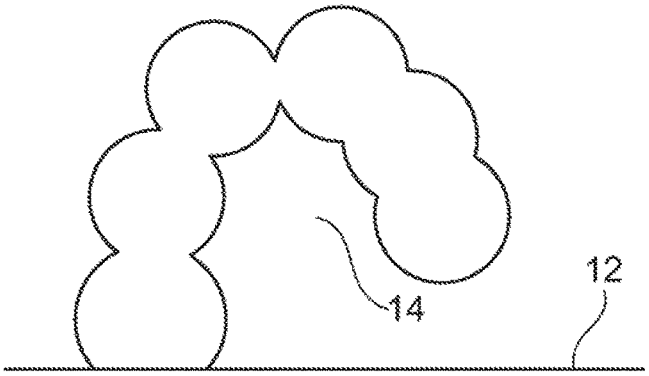

In FIGS. 19 and 21, the application member 20 forms a loop that is closed. As illustrated in FIGS. 22 to 23, the application member 20 can form an unclosed loop. The loop could be open at one of its junctions to the central part 12 as illustrated or the loop could be formed by an opening in the application member 20.

Of course, the invention is not limited to the examples that have just been described. For example, the number of application members may be different in each of the examples.

For example, it is possible to stack on the core elements 10 which are not identical, being made for example of different materials, notably with different hardnesses, and/or having application members with different shapes.

The core can be given a curvature, such that the applicator part extends along a curved longitudinal axis.

The invention claimed is:

1. An applicator for applying a cosmetic composition to eyelashes or eyebrows, comprising:

a core, at least one element attached to the core, said at least one element comprising a central part fitted onto the core and at least one application member carried by the central part, said at least one application member having a proximal half attached to the central part and a distal half extending outward from the proximal half, a composition collection surface being formed by a relief on the distal half that defines a concavity that is open radially toward an outside, the distal half corresponding to a portion situated at a distance from the central part along an elongation axis of the said at least one application member above the half of a total length of said at least one application member measured along the elongation axis of said at least one application member, the concavity being free of any protruding relief within the concavity, a half of the concavity being symmetrical to another half of the concavity relative to a median axis of symmetry of the one concavity, wherein the median axis of symmetry of the concavity being coincident with the elongation axis of said at least one application member, the application member being formed by a strand of material, the application member comprising a plurality of straight arms and/or arms of constant cross-section defining between them said concavity.

2. The applicator according to claim 1, wherein said at least one application member has two diverging arms that define said concavity between one another.

3. The applicator according to claim 2, wherein the arms are rectilinear, said concavity having the overall shape of a V.

4. The applicator according to claim 2, wherein said at least one element comprises a plurality of said at least one application member that each have an X-shaped head that is attached to the central part by a leg.

5. The applicator according to claim 2, wherein said at least one element comprises said at least one application member having an enlarged base.

6. The applicator according to claim 1, wherein said at least one element comprises at least one toothed application member having a plurality of teeth, the teeth being formed by a succession of pointed arches that are concave toward the outside, said concavity being formed by one of the arches.

7. The applicator according to claim 6, wherein the concavity is open in a direction that makes an angle of less than or equal to 30° with the elongation axis of said at least one application member.

8. The applicator according to claim 1, wherein said at least one element comprises said at least one application member having two lateral arms joined together at their end by an arch having a concave shape defining said concavity.

9. The applicator according to claim 1, wherein said at least one element has a plurality of identical said at least one application member that each have said concavity.

10. The applicator according to claim 1, wherein the core is twisted.

11. The applicator according to claim 1, wherein elongation axes of the said at least one application member of said at least one element are coplanar.

12. The applicator according to claim 1, wherein said at least one application member of said at least one element is flattened in a plane.

13. The applicator according to claim 1, wherein said at least one application member of said at least one element have their flattening plane oriented in a plane containing the axis of the central part.

14. A packaging and application device comprising:

a container containing the composition to be applied, an applicator as defined in claim 1.

15. A method for a cosmetic treatment of the eyelashes and/or eyebrows, notably for making them up, comprising the step of applying a cosmetic composition to the eyelashes with an aid of an applicator according to claim 1.

16. The applicator according to claim 1, wherein each said at least one application member carried by said at least one element is flattened in a flattening plane common to all said at least one application member carried by said at least one element.

17. An applicator for applying a cosmetic composition to eyelashes or eyebrows, comprising:

a core, at least one element attached to the core, said at least one element comprising a central part fitted onto the core and at least one application member carried by the central part, said at least one application member having a proximal half attached to the central part and a distal half extending outward from the proximal half, a composition collection surface being formed by a relief on the distal half that defines a concavity that is open radially toward the outside, the distal half corresponding to a portion situated at a distance from the central part along an elongation axis of said at least one application member above the half of a total length of said at least one application member measured along the elongation axis of said at least one application member, wherein said at least one element comprises a plurality of said at least one application member:

that each have a leg extending from the element and, at a distal end of the leg, four branches forming a X-shaped head, or that are formed by a strand of material comprising a plurality of pointed teeth that are each joined on both sides to a base of the element or to an adjacent pointed tooth by an arch having a concave shape, one of the arches joining two adjacent teeth defining said concavity.

* * * * *